United States Patent [19]

Beard et al.

[11] Patent Number: 4,771,584

[45] Date of Patent: Sep. 20, 1988

[54] CONCRETE BLOCK WALL CONSTRUCTION METHOD

[75] Inventors: Buddy M. Beard; Joe M. Beard, both of Sparks, Nev.

[73] Assignee: F. Bon Jasperson, Washington, D.C.

[21] Appl. No.: 33,194

[22] Filed: Apr. 2, 1987

[51] Int. Cl.[4] ..... E04B 2/14

[52] U.S. Cl. ..... 52/596; 52/744; 52/747

[58] Field of Search ..... 52/747, 744, 600, 603, 52/606, 439, 561, 743, 421, 596

[56] References Cited

U.S. PATENT DOCUMENTS

| | | | |
|---|---|---|---|
| 3,902,296 | 9/1975 | Thomas | 52/747 |
| 4,091,587 | 5/1978 | Depka | 52/561 |
| 4,237,670 | 12/1980 | De Waele | 52/747 X |
| 4,514,949 | 5/1985 | Crespo | 52/603 X |

*Primary Examiner*—J. Karl Bell

*Attorney, Agent, or Firm*—Murray and Whisenhunt

[57] ABSTRACT

A hollow concrete block wall, and method of making same, are disclosed. A first course of hollow concrete blocks are laid end-to-end abutting relationship, a pair of separate redwood strips are placed on top of the wall, a second course of hollow concrete blocks are laid on the redwood strips, with the strips serving to align the second hollow concrete block course at the bottom surface thereof, a second pair of redwood strips are laid on top of the second course of blocks, and so forth until the wall is in place. Thereafter, pourable settable cementitious material is introduced into the hollow spaces inside the concrete blocks, as well as the area between each pair of redwood strips, and the cementitious material permitted to set. The redwood strips maintain the wall in the dry stack condition by a friction bond between the redwood strips and the concrete blocks until the cementitious material has set.

13 Claims, 2 Drawing Sheets

FIG. 6
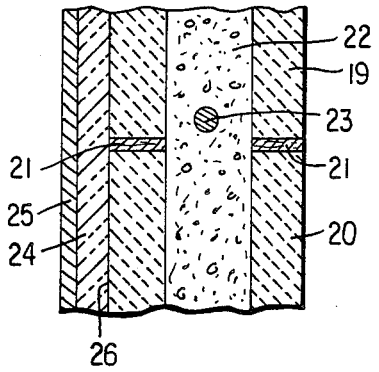
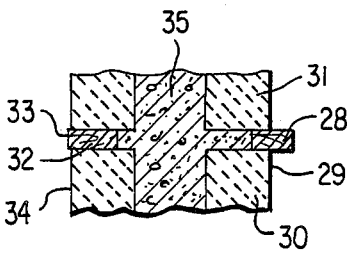
FIG. 7
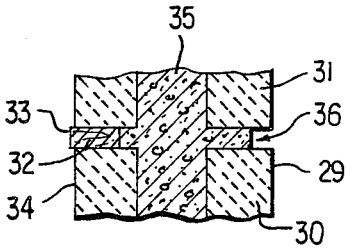
FIG. 8
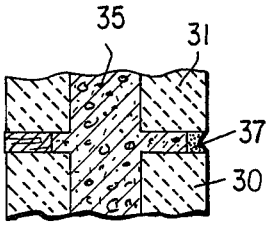
FIG. 9
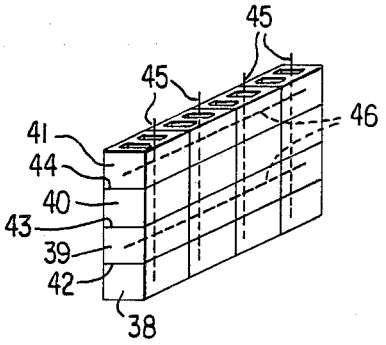
FIG. 10

CONCRETE BLOCK WALL CONSTRUCTION METHOD

FIELD OF THE INVENTION

The present invention is directed to a method of producing a dry stack concrete block wall, and to the wall so produced.

BACKGROUND OF THE INVENTION

After several millenia of wall construction using stone and mud as well as straw and clay and secret mixtures for mortar, modern masonry construction began with the development of portland cement just before the turn of the 20th century. The development of a mixture of sand, gravel, cement and water which could be poured, molded, and the like, and which would later set into solid form would not produce a useful construction material except for the fact that reinforcing steel can be used in the concrete to make reinforced concrete. Reinforced concrete is a composite material that is possible because the coefficients of expansion of steel and of stone are about the same. Steel alone is strong in tension but weak in compression, whereas concrete is strong in compression but weak in tension. When the two are used in combination the weaknesses cancel each other, producing a material which has the property of an instant rock that won't break or pull apart.

Concrete block was introduced to take advantage of the several functional attributes of clay brick, such as modular size, ease of manufacturing and handling, and still take advantage of the major advantage of concrete, the ability to be reinforced with steel. Concrete blocks are commonly made in hollow core units which are 8 inches high, 8 inches wide and 16 inches long, and are designed so that all of the hollow cores, or selected hollow cores, may be filled solid with concrete and reinforcing steel. The steel is normally placed both vertically and horizontally, and spans the length and depth of the multiple concrete block array.

Clay brick was also adapted for use in construction with reinforced concrete, with the new products being known as clay tile units. In many reinforced concrete wall applications the traditional clay brick continues to be used as an interior or an exterior "facing" material, primarily because of the decorative appeal of brick.

Even though concrete block and clay tile are used in modern structural construction only as a "remain in place" form for the reinforced concrete which is placed internally in the block, methods of wall erection have remained those traditionally used for a clay brick wall. That is, each modular unit is cemented into place using a mortar which weakly bonds that unit to adjacent units. This process is slow and labor-intensive, and requires a number of skills which may only be obtained through long apprenticeship or work experience. These factors have served to limit the widespread use of reinforced concrete in building construction. As a result, much effort has been spent since the introduction of concrete block as a building product in seeking a new method of constructing a concrete block wall which would not require additional masonry skills. The search for a new method of concrete wall erection has been primarily centered around one factor, the elimination of the need for a mortar bond between the blocks. With attention focused on the need to eliminate the mortar bond, most past attempts to develop a new method of concrete block wall erection have been directed toward new block design or toward improvements in block manufacturing equipment so as to manufacture a more precise concrete block unit.

The concrete block units are machine made, with a measured amount of concrete placed in a steel mold and compressed, usually by vibration, with the molded product removed for curing or firing before use as a building product. Because of the need for hollow core construction, which affects the geometry of the mold, and the difficulty of maintaining the exact volume of material introduced into the mold, concrete blocks are normally irregular in height. Although the variation between individual blocks is normally less than one-eigth of an inch, this irregularity is enough, because of the accumulation of errors, to prevent a true and plum wall from being laid up without the use of mortar.

A mason using mortar can make on-site corrections of irregularities in a concrete block wall as the wall is being built. The manner in which the irregularities are corrected is illustrated in FIG. 1, wherein the use of the mortarbed has eliminated the height irregularities in the concrete blocks, and any irregularities in the wall foundation. The mason will always work with a taut line and level to keep the tops of the concrete blocks of each new course level and true.

Attempts have been made to manufacture precision concrete blocks by making the blocks all slightly oversized and then running each block through a shaper, wherein a grinding process is utilized to obtain a uniform required height. The reverse method has also been tried, wherein all blocks were initially made undersized, and then a topping of cementitious material was applied to each block to build each block up to a uniform height.

A number of specially designed "dry-stack" blocks have been manufactured, with the most successful of these using a "precision" shoulder at the top of the block as an interlocking feature with the block stacked above. Such a block is illustrated in FIG. 2, and the rationale of the use of such a block design will be readily noted. The true block height "x" remains dimensionally unstable, but the dimension "y" is more precise since the shoulder on top of the block is machine made. A notable disadvantage of the use of these blocks lies in the potential for deformation of the base, since the uncured block can spread the "feet" which must support the entire weight of the block, unless extraordinary care is taken in block manufacture and handling.

The Bingham U.S. Pat No. 2,325,653 discloses a block or tile wall wherein facing strips of asphalted felt, impregnated cork, or a compound of asbestos fibers and asphalt are placed between the blocks of each course and between each of the courses in the wall. The strips are placed inward of the wall faces, so that when the blocks of the next course are set upon a given strip in proper relation to the course below a bonding space is provided longitudinally between the courses to receive bonding cement or mortar. The bonding cement or mortar is applied, with the spacers providing an effective seal along the bond areas against the passage of moisture through the wall, and prevent cement or mortar from dropping into the voids or aircells formed in the hollow tile or block. After the Bingham wall is constructed, the hollows in the blocks or tiles still remain, and no reinforcing steel is contemplated.

The Stevens U.S. Pat. No. 764,313 discloses the use of adhesive strips laid between and joining successive courses of building blocks. The adhesive strips may be of felt, paper, wood or any suitable absorbent material, which has been thoroughly impregnated with liquid cementing material such as asphalt. Stevens indicates that the strips when placed in position form positive supports for the blocks and compress equally. Thus the use of irregular blocks in the Stevens construction would result in the formation of a wall which was not true. The asphalt in the strips soon sets or hardens to form a joint of great strength and hardness which is much more durable than ordinary mortar. The joints between the adhered bricks can be pointed if desired. The blocks which are used in the Stevens patent do not appear to be hollow. Stevens teaches that a dead-air space may be left between the adhesive strips entirely around the block, or if desired the space may be filled with asphalt or other cementing material.

The Bennett U.S. Pat. No. 2,065,510 discloses the use of wood spacers having camming surfaces for leveling or positioning stones of irregular thickness.

Other patents relating to walls or the like of building blocks or tiles include Kertes U.S. Pat. No. 1,058,674, Sayers U.S. Pat. No. 1,785,499, Comm U.S. Pat. No. 3,722,168 and Klem U.S. Pat. No. 3,795,079.

SUMMARY OF THE INVENTION

The present invention is directed to a method of erecting a concrete block wall which obviates the prior art problems discussed above. The present method, unlike the prior art approaches to solve the concrete block wall problems by block designs, is instead designed to negate the effect of irregularities in block height. Redwood strips or lathes are used to align each course of concrete blocks with the adjacent courses by automatically providing leveling at the bottoms of the blocks or tile, particularly when the block is laid with a "stacked" bond (i.e., one block directly above and in line with the one below) instead of a "running" bond (wherein alternate courses are offset by the width of a half-block). However, with either type of bond, the automatic leveling provided by the redwood strips of the present invention will be achieved.

BRIEF DESCRIPTION OF THE DRAWINGS

The present invention will be understood more readily by reference to the accompanying drawings, wherein:

FIG. 6 is a cross-sectional view through a portion of a wall of the present invention, taken along line 6—6 of FIG. 3, with exterior insulation and finish shown mounted on the exterior side of the wall and nailed to the wall, FIG. 7 illustrates a cross-section of the wall, similar to the view of FIG. 6 (without exterior insulation or finish), with one of the redwood strips being mounted for removal after the poured cementious material in the center of the wall has set, FIG. 8 illustrates the wall of FIG. 7 after the removal of the protruding redwood strip, and FIG. 9 illustrates the joint of FIG. 8 after pointing and tooling to make a "Vee" weatherproof joint.

FIG. 10 illustrates a portion of the wall of the present invention showing horizontal and vertical steel reinforcing bars therein.

DETAILED DESCRIPTION OF THE INVENTION

Figure 1:
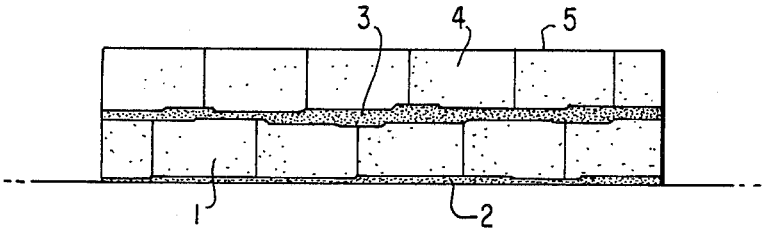
FIG. 1 (PRIOR ART)
FIG. 1 illustrates a prior art concrete block wall, wherein mortar has been used to make the necessary corrections of the block irregularities.
Figure 2:
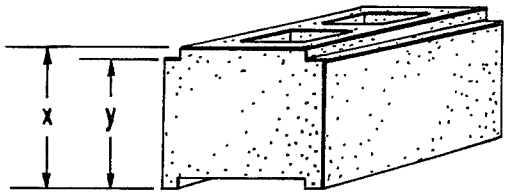
FIG. 2 (PRIOR ART)
FIG. 2 illustrates a prior art "dry stack" block.

The manner in which a mason corrects irregularities in a prior art concrete block wall construction method is illustrated in FIG. 1. After an initial course of blocks are laid, the mason works with a taut line and level, and uses a mortarbed to eliminate height irregularities of the block. Thus a course 1 of concrete block is set on a mortarbed 2, and then a second mortarbed 3 is used to eliminate tight irregularities in the alignment of a second row 4 of concrete blocks. A taut line and level (not shown) are used to keep the tops 5 of each block of row 4 level with each other. In FIG. 1, the undersized concrete blocks have been exaggerated for clarity.

Figure 3:
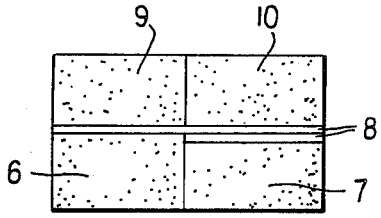
FIG. 3 illustrates a portion of the wall of the present invention, with the wall being of "stacked" bond concrete blocks, separated by redwood strips or lathes.

The method of the present invention is a dramatic departure from the methods by which others have attempted to solve the problem of aligning concrete block walls, in that the method of the present invention is not at all dependent upon a particular block design. In other words, instead of attempting to make a more suitable block, which has been tried again and again with little success as concrete is not a good material for precision molding, the approach of the present invention is to negate the effect of irregularities in the block height through the use of, in essence, a pre-manufactured rigid mortarbed. In FIG. 3, normal size block 6 and undersize block 7 are laid in place using conventional techniques. A pair of redwood strips 8 are laid over these blocks, and act to minimize the transmission of block height irregularities from the course containing blocks 6,7 to the course above. To form the course above, blocks 9 and 10 are laid on top of blocks 6 and 7, with the redwood strips 8 separating the blocks. Further redwood strips (not shown) separate each succeeding course (not shown) from the course below, and with multiple courses the effect is toward averaging instead an accumulation of errors.

Redwood is the material of choice for the strips separating the blocks of each course. Redwood is preferred because of its compatibility with cement, and because it possesses the required rigidity yet retains enough resilience to allow penetration of small imperfections, such as protruding bits of gravel and the like, on the plane surface of the block.

The redwood strips are preferably ¼ to 1¼ inches thick, and preferably about three-eighths of an inch thick. The strips can be of any width up to a width such that the combined width of the two strips is just less than 50% of the width of the concrete blocks. If the redwood strips are wider than this, they may interfere with the pouring of grout material into the space inside of the concrete blocks. The redwood strips may be of any length, with relatively short lengths, such as, for instance, just about 6 feet long, being convenient to handle. A plurality of redwood strips may be stapled or glued or otherwise joined together to form a longer redwood strip, although it is preferred for strip rigidity to minimize the number of such joints. The redwood strips automatically provide leveling at the bottoms of the concrete blocks, particularly when the block is laid "stack" bond instead of "running" bond. The wood strips serve to accomplish the main functions of the prior art mortar. The strips serve to hold the blocks apart a predetermined degree, and serve as a means to adjust for height variation between individual blocks. When a wall is laid "stack" bond, the sliding resistance between individual blocks and the redwood strips, especially if small block imperfections penetrate the strip surfaces, serves to stabilize a dry-stack block wall prior to introduction of grout therein. That is, the redwood strips tend to keep the blocks in stable position by preventing lateral sliding or other movement relative to each other.

To explain otherwise, because the redwood is slightly compressible, and imprinted by the rough surfaces of concrete blocks above and below the strips, an excellent friction bond will be made between the blocks and the redwood. This bond results in a very stable wall, and consequently, unlike walls built with some dry-stack design blocks, requires no special care when grouting the hollow cores of the block with concrete. Once the walls are grouted solid with concrete, the internal web of reinforcing concrete provides the walls with structural strength.

While some walls may be built with no reinforcing steel therein, it will be normally preferable to use horizontal and vertical reinforcing steel bars or rods in the concrete block walls of the present invention. The vertical or substantially vertical reinforcing members can be inserted through the hollow cores of the concrete blocks. For the horizontal reinforcing steel members, a portion of the block web may have a holiday or cutout therein, as is well known to those in the art, and the reinforcing steel bars can be inserted in a horizontal direction through the holidays or cutouts. In forming an eight foot wall, horizontal reinforcing steel members will normally be used at least at the wall base and top, and preferably about every two feet or so. Normally a vertical steel reinforcing member will be located at least every 6 feet along the wall, and preferably about every 2 feet or so. In addition to the reinforcing steel members mentioned above, normally additional steel reinforcing members will be located on wall corners and around openings in the wall.

The concrete grout poured into the dry-stack concrete block wall may be poured into a wall having a vertical height of 8 feet or so in a single pour, or in several pours. When several pours are utilized, normally only a portion of the wall will be built by the above-described dry-stack method, and then that portion of the wall will be fully grouted with concrete, and then the next wall section will be built.

Any conventional concrete grout can be utilized, including concrete grouts containing resin additives and other conventional additive materials.

Because of the friction fit with the redwood strips of the present invention, the blocks are kept in line and prevented from pulling apart at the head joints (end of block). Some dry-stack block designs of the prior art have even had interlocking features between adjacent blocks, on an end-to-end basis, but such interlocking features are not necessary with the redwood strips of the present invention, which can use blocks having sides and ends which are smooth precision surfaces, arising from the block mold. Because of this, if the base of adjacent blocks are level, an end-to-end butt joint with standard blocks has a tight fit.

The self-leveling feature of the present invention allows the concrete block walls of the present invention to be built by unskilled rather than skilled workmen. Because each block is laid dry, adjustments are possible to each new course after the course is laid. That is, a row of blocks can be laid and than a taut string line used to check the straightness of the entire row. This is in contrast to the prior art approach of laying block with mortar, wherein the corners of a wall are built first, and then the block laid to a taut line between the corners. This prior art approach was necessary because once laid in mortar the block cannot be moved once the mortar begins to set, which is generally within several minutes. This requires that each block be carefully laid in line as the row progresses.

With the method of the present invention, the block wall can be laid quite quickly, up to 3 to 10 times as fast as by laying up a wall using the conventional mortar approach. This increases the productivity of the workmen, and also has the potential for future labor savings by the use of robotics.

The method of the present invention allows the use of a dry-stack concrete block wall having a stack bond instead of a running bond. By using a stack bond wall, the use of half-blocks can be eliminated. Framings for wall openings may also be eliminated.

Figure 4:
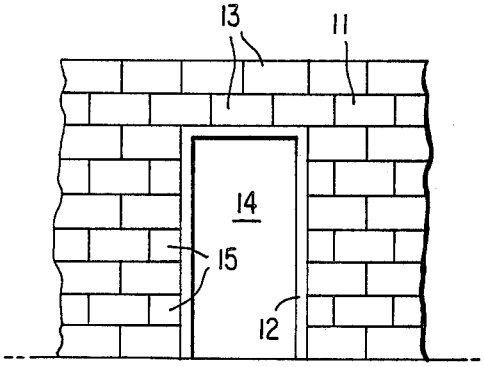
FIG. 4 (PRIOR ART)
FIG. 4 represents a prior art construction to form a door or window opening, requiring the use of temporary framing and half blocks.

FIG. 4 represents a typical construction of a prior art concrete block wall 11, wherein temporary framing 12 is required to support the blocks 13 immediately above opening 14. On the sides of the opening, half blocks 15 are utilized to form a relatively stt the blocks 13 immediately above opening 14. On the sides of the opening, half blocks 15 are utilized to form a relatively straight surface abutting temporary framing 12.

Figure 5:
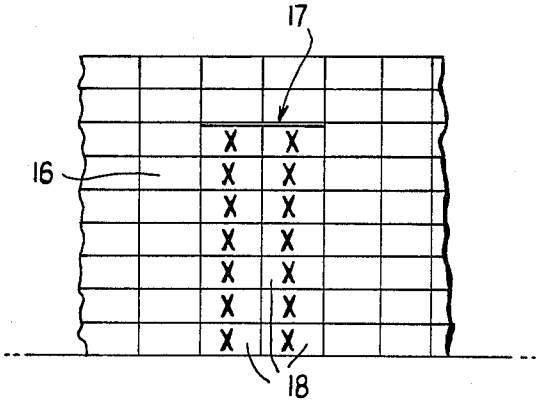
FIG. 5 illustrates a stacked bond wall of the present invention, utilizing a simple grout stop to provide an opening in the wall for a window or door.

FIG. 5 represents the construction of a stack block concrete block wall 16 made of a plurality of identical sized concrete blocks. A grout stop 17 is mounted horizontally above blocks 18 (each marked with an "X") which are to be removed after the wall is grouted solid. The wall 16 is laid dry, and then grout is poured into the wall cavities from the top of the wall. Grout stop 17 prevents grout from entering blocks 18. After the grout has set, blocks 18 (and, if desired, the grout stop 17) can be readily removed, thereby forming the desired opening in the wall 16. It will be readily noted from FIG. 5 that the use of half blocks is eliminated. The temporary formwork is also eliminated by the use of the grout stop above the desired opening. When the wall is filled solid with poured concrete grout, the grout will not flow into the blanked off area, so that the ungrouted block can be later easily removed. The redwood strips which are between each course of concrete blocks have not been shown in FIG. 4 for clarity.

When concrete block having holidays or cutouts in the webs thereof are utilized, a concrete grout having good flow characteristics can actually flow under windows through such holidays or cutouts. Otherwise, it may be necessary to have an extra pour of concrete grout into the blocks underneath a window or other opening not extending to the bottom of the block wall.

In many instances various sheeting or panels or other similar planar materials are nailed to masonry walls. The redwood strips of the present invention serve another important function in providing a base for nailing to both the interior and exterior surfaces of the wall.

For instance, it is a common construction to apply gypsum board over firring strips as an interior finish to a concrete block wall. Ordinarily, concrete nails, often applied by the use of power tools, are used as the fasteners. Nail strips built into the walls allow fastening by the use of common nails, and would simplify and expedite the task of interior finishing. The redwood nailing strips of the present invention have a more important function, however, in the application of exterior insulation and finish to the exterior side of the concrete wall. The application of exterior insulation to masonry walls is becoming more commonplace in construction, due to the need to build structures which are more energy conserving than traditional buildings have been. Nailing insulation into a hard concrete surface is a problem even with concrete nails because the nail shaft is without support within the area of the insulation, so that the nail frequently bends. The redwood strips of the present invention solve this problem, as the redwood can be readily penetrated by common nails. Even though the strips may be only three-eighths of an inch in thickness, an ideal nailing surface is obtained because the strips are maintained in compression by the blocks above and below the strip. Because the compression will not allow the wood strips to expand vertically upon nail penetration, the wood does not split and as a result binds the nail as well as would a much larger piece of wood in conventional construction.

FIG. 6 represents a cross-sectional view of a wall of the present invention, wherein concrete blocks 19 and 20 are separated by a pair of redwood strips 21, which preferably are located substantially flush with the surface of the wall. Concrete grout 22 fills the interior space of concrete blocks 19 and 20. Horizontal reinforcing steel rod 23 has been placed in the dry-stack wall (through holidays in the block webs) prior to the pouring of the concrete grout. Similarly, vertical steel reinforcing rods (not shown) are also installed in the dry-stack wall prior to the concrete grout pouring.

After the concrete grout has set, a layer of insulation 24 and a sheet of exterior finish 25 are placed over the exterior wall 26 of concrete blocks 19, 20. A plurality of nails 27, passing through exterior finish 25 and insulation 24, and penetrating redwood strips 21, serve to hold exterior finish 25 and insulation 24 on outer surface 26 of blocks 19, 20.

In addition to insulation, other materials which can be nailed into the redwood strips of the concrete block walls of the present invention include firring strips, sheetrock, exterior siding, and the like. Since the redwood strips have performed their other functions (that is, the block alignment, the leveling of the block courses, and the holding of the wall together until the grout poured into the cavities has set) by the time the grout has set, it is possible to either leave the strips in place, or remove the redwood strips if they are not required for nailing purposes. If a redwood strip is to be removed from a wall, it will normally be preferred to have the strips in the position shown in FIG. 7, with a significant amount, preferably about one-half, of the redwood strip 28 protruding past the surface 29 of concrete blocks, 30, 31. The other redwood strip 32 is preferably mounted so that the outer surface 33 thereof is substantially in about the same plane as surface 34 of blocks 30, 31. After the dry-stack wall is formed, concrete grout 36 is poured into the wall cavities, and allowed to set. After grout 35 has set, redwood strip 28 is removed, resulting in the structure shown in FIG. 8, with gap 36 being in the area normally occupied by redwood strip 28. If grout does not completely fill the gap between walls 30, 31 to the point where redwood strip 28 acted as a grout-stop, the joint can be pointed as a finishing touch to the wall. Of course, the use of a grout having better flow characteristics could eliminate any such imperfections. If desired, the joint between blocks 30, 31 can be pointed and tooled to make a "Vee" weatherproof joint, as illustrated in FIG. 9, wherein mortar 37 has been used in pointing the joint.

FIG. 10 illustrates a wall of the present invention, having a significant amount of horizontal and vertical steel reinforcements therein. Concrete block courses 38, 39, 40 and 41 are separated from each other by pairs of redwood strips located at joints 42, 43 and 44 (the strips themselves are not shown for purposes of clarity). Prior to the concrete drought being poured into the interior of the concrete blocks, the plurality of vertical steel reinforcing rods 45 and horizontal steel reinforcing rods 46 are placed in the wall, with rods 45 being simply inserted into openings in the concrete blocks themselves, and rods 46 being inserted through cutouts in the webs of the concrete block.

In many situations the redwood strips of the present invention will handle all of the required vertical adjustment of the concrete blocks in making a wall by the process of the present invention. In some instances, however, if more adjustment is required, it may be desirable to use shims of wood or plastic or the like. This approach might be useful, for instance, when the base foundation was quite far from being level.

It is greatly preferred that concrete block which is utilized in the method of the present invention, and that is used to construct the wall of the present invention, is a hollow block having an opening extending through the block from top to bottom when laid in a wall in the normal orientation of such concrete blocks. Furthermore, it is preferred for some applications that the block be open on at least one end, especially when utilizing a stacked bond arrangement of blocks, so that concrete grout can be poured into the open-end area to bind adjacent stacks of blocks together. It will be realized, of course, that normally horizontal reinforcing bars of steel or the like will be included in the walls, and will serve to hold the walls together, but for the most robust construction it is possible to have each stack of concrete blocks grouted to the adjacent stack.

We claim:

1. A built-up structure comprising a series of hollow concrete blocks disposed end-to-end in a plurality of courses defining a plane, with a junction line between adjacent courses, a pair of nailable, separate block alignment strips located between at least certain of adjacent courses of concrete blocks and aligning the blocks of such courses at the bottom thereof, said strips consisting essentially of redwood and being placed substantially along the length of the aligned course thereon, and having a combined width which is less than about 40% of the width of the concrete blocks, said strips being substantially of the same thickness, which is about one-fourth inch to about one inch, one of said strips proximate one face of the structure and the other strip proximate the opposite face of the structure and defining an open gap thereinbetween, with neither strip projecting beyond the face of the structure, said concrete blocks joined into an integral mass by hardened cementitious material disposed inside the concrete blocks and in said gap, said strips and said blocks cooperating, before the cementitious material is placed inside the concrete blocks, and with the structure being in the dry-stack condition to stablize the dry-stack block wall by the friction bond therebetween.

2. Structure of claim 1, wherein reinforcing steel is located in the said hardened cementitious material.

3. A method of constructing a planar wall of concrete blocks, said method comprising providing a foundation upon which the wall will be erected, laying a first course of hollow concrete blocks having faces in end-to-end abutting relationship, placing a pair of separate redwood strips on top of and along the length of said first course with the strips being located between the faces of the concrete blocks and not projecting therepast, said strips being of substantially the same thickness and having a combined width less than about 40% of the width of the concrete blocks, said thickness being about one-fourth inch to about one inch, laying a second course of hollow concrete blocks upon said strips with the strips aligning said second course at the bottom surface thereof, placing a second pair of said redwood strips on top of and along the length of said second course with the strips being located between the faces of the concrete blocks and not projecting therepast, laying a third course of hollow concrete blocks upon said strips with the strips aligning said third course at the bottom surface thereof, and so on until said wall is in place, and then introducing pourable, settable cementitious material into the hollow spaces of the concrete blocks and the area between each pair of strips by pouring said cementitious material into the hollow spaces of the top course of concrete blocks, and thereafter permitting the cementitious material to set while maintaining the wall in the dry-stacked condition during construction and introduction of the cementitious material and until the cementitious material has set by the friction bond between the redwood strips and the concrete blocks.

4. Method of claim 3, wherein the outer edge of at least one strip is located proximate a face of the concrete blocks to provide a nailing surface.

5. Method of claim 3, including the additional step of placing reinforcing steel members into the hollow spaces of the concrete blocks before the pourable, settable cementitious material is introduced therein.

6. Method of claim 4, including the additional step of attaching facing material on a face of the concrete blocks by nailing the facing material to at least certain of the redwood strips.

7. A built-up structure comprising a series of hollow concrete blocks disposed end-to-end and in vertical alignment in a stacked-bond configuration in a plurality of courses defining a plane, with a junction line between adjacent courses, a pair of nailable, separate block alignment strips located between at least certain of adjacent courses of concerete blocks and aligning the blocks of such courses at the bottom thereof, said strips consisting essentially of redwood and being placed substantially along the length of the aligned course thereon, and having a combined width which is less than about 40% of the width of the concrete blocks, said strips being substantially of the same thickness, which is about one-fourth inch to about one inch, one of said strips proximate one face of the structure and the other strip proximately the opposite face of the structure and defining an open gap thereinbetween, said concrete blocks joined into an integral mass by hardened cementitious material disposed inside the concrete blocks and in said gap.

8. Structure of claim 7, wherein reinforcing steel is located in the said hardened cementitious material.

9. A method of constructing a planar wall of concrete blocks, said method comprising providing a foundation upon which the wall will be erected, laying a first course of hollow concerete blocks in end-to-end abutting relationship, placing a pair of separate redwood strips on top of and along the length of said first course, said strips being of substantially the same thickness and having a combined width less than about 40% of the width of the concrete blocks, said thickness being about onefourth inch to about one inch, laying a second course of hollow concrete blocks in stacked-bond configuration upon said strips with the strips aligning said second course at the bottom surface thereof, placing a second pair of secourse course redwood strips on top of and along the length of said second course, laying a third course of hollow concrete blocks in stacked-bond configuration upon said strips with the strips aligning said third course at the bottom surface thereof, and so on until said wall is in place, and then introducing pourable, settable cementitious material into the hollow spaces of the concrete blocks and the area between each pair of strips by pouring said cementitious material into the hollow spaces of the top course of concrete blocks, and thereafter permitting the cementitious material to set.

10. Method of claim 9, wherein the outer edge of at least one strip is located adjacent a face of the concrete blocks to provide a nailing surface.

11. Method of claim 9, wherein at least certain of the strips along one of the surfaces of the wall are removed after the cementitious material has set.

12. Method of claim 9, including the additional step of placing reinforcing steel members into the hollow spaces of the concrete blocks before the pourable, settable cementitious material is introduced therein.

13. Method of claim 10 including the additional step of attaching facing material on a face of the concrete blocks by nailing the facing material to at least certain of the redwood strips.

* * * * *